US008720716B2

(12) United States Patent
Campbell

(10) Patent No.: US 8,720,716 B2
(45) Date of Patent: May 13, 2014

(54) CLOSURE WITH SPRING LOADED TETHER DOCKING

(76) Inventor: Phillip John Campbell, Raleigh, NC (US)

( * ) Notice: Subject to any disclaimer, the term of this patent is extended or adjusted under 35 U.S.C. 154(b) by 226 days.

(21) Appl. No.: 12/803,336

(22) Filed: Jun. 24, 2010

(65) Prior Publication Data

US 2010/0326948 A1 Dec. 30, 2010

Related U.S. Application Data

(60) Provisional application No. 61/269,517, filed on Jun. 25, 2009, provisional application No. 61/395,345, filed on May 12, 2010.

(51) Int. Cl.
*B65D 41/34* (2006.01)

(52) U.S. Cl.
CPC ..... *B65D 41/3428* (2013.01)
USPC ..... 215/253; 215/252; 215/258; 220/375

(58) Field of Classification Search
CPC ..... B65D 41/3428; B65D 41/3447; B65D 41/3409; B65D 2101/0053; B65D 2101/0046; B65D 41/48; B65D 2101/0038; B65D 41/44; B65D 55/16; B65D 35/42
USPC ..... 220/288, 289, 315, 327, 345.1, 345, 220/265, 375; 215/250, 252, 253, 258, 306, 215/254, 256, 901

See application file for complete search history.

(56) References Cited

U.S. PATENT DOCUMENTS

| | | | | | |
|---|---|---|---|---|---|
| 3,904,062 | A | | 9/1975 | Grussen | |
| 4,394,918 | A | | 7/1983 | Grussen | |
| 4,557,393 | A | * | 12/1985 | Boik | 215/253 |
| 4,564,114 | A | * | 1/1986 | Cole | 215/256 |
| 4,805,792 | A | | 2/1989 | Lecinski | |
| 5,080,246 | A | * | 1/1992 | Hayes | 215/252 |
| 5,215,204 | A | | 6/1993 | Beck et al. | |
| 5,360,126 | A | * | 11/1994 | Snyder et al. | 215/252 |
| 5,725,115 | A | | 3/1998 | Bösl et al. | |
| 5,853,095 | A | * | 12/1998 | Marshall et al. | 215/252 |
| 6,053,344 | A | * | 4/2000 | Gregory et al. | 215/252 |
| 6,302,286 | B1 | * | 10/2001 | Witherspoon | 215/11.6 |
| 6,474,491 | B1 | | 11/2002 | Benoit-Gonin et al. | |
| D593,856 | S | * | 6/2009 | Kubler | D9/446 |
| 7,712,619 | B2 | * | 5/2010 | Schwarz et al. | 215/252 |

* cited by examiner

*Primary Examiner* — Robert J Hicks
*Assistant Examiner* — Kareen Rush
(74) *Attorney, Agent, or Firm* — Hershkovitz & Associates, PLLC; Abraham Hershkovitz

(57) ABSTRACT

A closure for a container has an integral tether section of the closure skirt attached to a tamper band at frangible sections. In the open position, the tether section has a free length providing for a plurality of resiliently docked closure positions retaining the closure on the container and not interfering with the transfer of contents therefrom.

17 Claims, 15 Drawing Sheets

CLOSURE WITH SPRING LOADED TETHER DOCKING

RELATED APPLICATION

This application claims the benefit of U.S. Provisional Application No. 61/269,517 filed on Jun. 25, 2009; and U.S. Provisional Application No. 61/395,345 filed on May 12, 2010.

FIELD OF THE INVENTION

The present invention relates to closures for containers and, more specifically, to a closure tethered in the open position in a docked position against a drinking or pouring container so as not to interfere with the use thereof.

BACKGROUND OF THE INVENTION

Many of the container closures at the present time are of the tamper evident type. This type of cap or closure usually provides a retaining ring that is intermittently attached to a main cap body by frangible sections of plastic that tear away when the cap is unscrewed. U.S. Pat. No. 7,228,979 issued to Long, Jr, on Jun. 12, 2007 shows this type of closure having a retaining ring 34 and cap body 32 with break-away stubs.

U.S. Pat. No. 6,474,491 issued to Benoit-Gonin et al. on Nov. 5, 2002 also shows this type of tamper evident closure. This closure goes on to show that once the cap is unscrewed it stays attached to the bottle by means of two arms of material that form a circle with film hinges that do not break upon opening of the container. This closure shows that a force is imparted from the cap to the bottle through a rigid stay that causes the cap to be held back away from the bottle mouth opening in a fixed position. This closure provides a fixed open position but the cap may interfere with the user's mouth and nose as the cap maintains a fixed position that is at a higher plane than that of the bottle or container mouth opening. When used on a pouring type vessel such as a motor oil bottle, this type of closure may interrupt the flow of the dispensing fluid for the same reason. U.S. Pat. No. 5,215,204 issued to Beck et al. on Jun. 1, 1993 shows a similar type closure having a tethering member that allows the cap to remain attached to the bottle after opening as well. This tethering method allows for the cap to loosely dangle and may get in the way of the user when drinking from the bottle. A similar approach is disclosed in U.S. Pat. No. 4,805,792 to Lecinski et al. having a further drawback in that the neck of the container must be increased to accommodate the elongated tether. The attendant tooling costs for neck redesign represents a large deterrent in a cost sensitive packaging sector. These prior art closures provide tethering but the caps interfere with the function of the bottle during use and necessitate undesirable and costly tooling changes to the closure/filler neck envelope.

SUMMARY OF THE INVENTION

Accordingly, it is the objective of the present invention to provide an improved closure that will allow the bottle closure or cap to remain with the container after opening yet not hinder the function of the vessel during use. Other objects of the invention are to provide a closure that: is inexpensive to manufacture; does not require a departure from in-place manufacturing processes and tooling; can be utilized on a wide variety of containers; reduces the litter and the animal consumption of loose caps; provides an improvement over existing closures. More particularly the invention provides an improved container closure that allows for the cap to remain fixedly and stably attached to the container after opening by the resilience of a twistable segment of cap material in the form of a tether affixed to the retaining ring and after opening assume plural stable, spring biased docked positions not interfering with intended use.

The cap remains out of the way for normal use of the container by means of inverting the cap with a pivoting motion to bring the cap to a hold-fast, held in place position facing downward and against the retaining ring and container through integrally contained constant spring like resilient force provided by the tether.

In one aspect the invention provides a container assembly including having a cylindrical neck portion with a central passage; an outwardly extending annular upper flange having an annular retainer space therebelow; a container thread formed on said outer surface of said neck portion above said upper flange; and an annular end surface surrounding said passage. A closure is provided having a circular cover section for engaging said end surface of said neck portion and a cylindrical skirt portion extending downwardly from said cover section and surrounding said neck portion of said container; a closure thread on an interior surface of skirt portion operatively engaging said container thread for manually raising and lowering of said closure with respect to said container between a closed position whereat said cover section engages said end surface and an open position wherein said threads are disengaged; an annular retaining band in said retaining space and having inwardly extending projections for engaging said upper flange to prevent upward movement of said band in assembly; a first sector of frangible sections connecting a lower end of said skirt portion to said retaining band, said first sector having end sections circumferentially spaced by a non-frangible connecting section; a second sector of frangible sections in said skirt section above said first sector and having a first end connected at one end section of said connecting section and a second end extending beyond the other end section thereby providing a circumferential tether section between said skirt section and said retaining band; said frangible sections severing during rotation of said closure to said open position, said tether section having a length; (a) accommodating movement of said closure from said open position to a first docked position wherein said skirt section engages and is resiliently biased against said neck portion by the tether section in a first docked position; (b) accommodating rotation of said closure about said tether section to a second docked position wherein said skirt portion engages and is biased by said tether section against said container transverse to said neck portion; and (c) accommodating rotation of said closure beyond said second docked position to a third docked position wherein said cover portion of the closure is resiliently biased by said tether section against the container by the tether. The tether section may span a sector of skirt section of about 90° and have an axial height of about ½ to ⅓ of said inside surface of said skirt section. The connecting section may span a sector of skirt section of about 30° to 45° and have a reduced radial cross section connecting with said retaining band allowing transverse pivoting of said tether section during movement to said docked positions.

In another aspect the invention provides a closure for the filler neck of a container, comprising: a closure body having a cover and a peripheral skirt for enclosing the neck of the container and a retaining band encircling the neck and retained against axial movement thereon; a circumferential tether formed in said skirt for connecting said closure body to the container after opening, said tether being defined by a first circumferential sector of weakened sections between said skirt and said band having a starting end and a finishing end on opposed sides of an integral bridge section flexibly connecting said band to said skirt, said tether being defined by a second circumferential sector of weaken sections formed in said skirt above said first sector, said second sector having a finishing end adjacent said finishing end of said first sector with said finishing ends being interconnected by an axial connecting section, said second sector having a starting end circumferentially extending beyond said starting end of said first section thereby providing a tether length circumferentially between said starting ends, a thread section on an interior surface of said skirt operative with a complementary thread section on an outer surface of the neck of the container for accommodating rotation of the cap to raise the closure body to an open position severing said weakened sections maintaining connection of said skirt to said retaining band by said tether, said tether length providing resilient biasing of said skirt against said neck in a docking position and rotation about said tether providing resilient biasing of said closure body against the container in a further docking position.

In a further aspect, the invention provides 10. A method of retaining a closure for a container in an opened docked position on a neck of a container for the unobstructed transfer of contents therefrom. The method includes providing a container having a filler neck with an axial passage terminating with an annular end surface wherein said filler neck includes a first thread section on an outer surface below said end surface and an annular outwardly extending retaining surface on said neck below said first thread section; providing a closure body having a circular top portion with a surface engaging said end surface of said neck and a cylindrical skirt portion depending from the periphery of said top portion and surrounding said neck and said first thread section, said skirt portion having an inner surface with a second thread section operatively engaging said first thread section for moving upon rotation said closure between a closed position and an open position; providing an annular retaining member at said retaining space connected to said skirt portion at a first sector of frangible material, wherein first and second ends of said first sector are separated by an axial non-frangible connecting section; providing a second sector of frangible material in said skirt portion axially above said first sector, said second sector having a starting end a circumferential distance remote from said first end of said first sector and said second section and having a finishing end at said connecting section intermediate said first and second ends, said finishing end being connected to said second end of said first sector by an axial weakened connecting sector; rotating said closure to said open position and thereby separating said tether section, said skirt section and said retaining member at said sectors; and providing a circumferential length for said tether section (i) accommodating movement of said closure from said open position to a first docked position wherein said skirt section engages and is resiliently biased against said neck portion by the tether section in a first docked position; (ii) accommodating rotation of said closure about said tether section to a second docked position wherein said skirt portion engages and is biased by said tether section against said container transverse to said neck portion; and (iii) accommodating rotation of said closure beyond said second docked position to a third docked position wherein said cover portion of the closure is resiliently biased by said tether section against the container by the tether.

BRIEF DESCRIPTION OF THE DRAWINGS

The above and other features and advantages of the invention will become apparent from the following description of the preferred embodiments of the invention taken in conjunction with the accompanying drawings in which.

DESCRIPTION OF THE PREFERRED EMBODIMENTS

Figure 1:
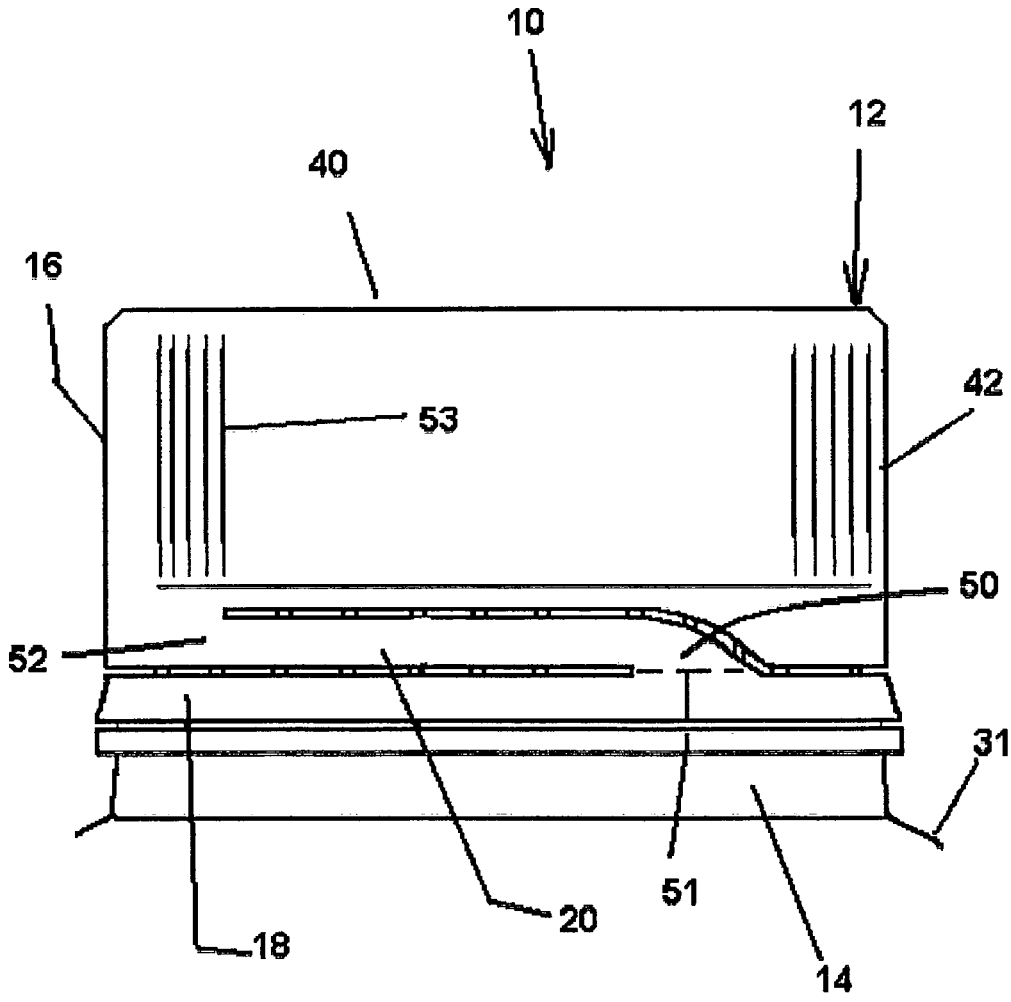
FIG. 1 is a partial front view of a tamper evident closure in the closed position on a container in accordance with an embodiment of the present invention.

Referring to the drawings for the purpose of illustrating embodiments of the invention and not for limiting same, FIG. 1 shows a container assembly 10 including a tamper evident closure 12 for sealing the contents of a container 14 in a closed position. The closure 12 is a molded one-piece body having a cap or closure body 16 that is integrally attached to a tamper band 18 by an integral flexible tether 20 The tamper band 18 is designed to stay axially in place but rotate and spin freely as the cap is unscrewed. In the opened condition as described in detail below, the cap 16 is resiliently biased against the container 14 in a plurality of stable docked positions that permit unobstructed pouring or consumption of the contents of the container without interference from the cap.

The present invention may be employed in a variety of applications including without limitation carbonated and non-carbonated beverages, foodstuffs, working fluids, capsules solid and liquid materials and the like. Typically, both the container and the closure use plastic based material, however, other combinations of materials are also usable.

Figure 3:
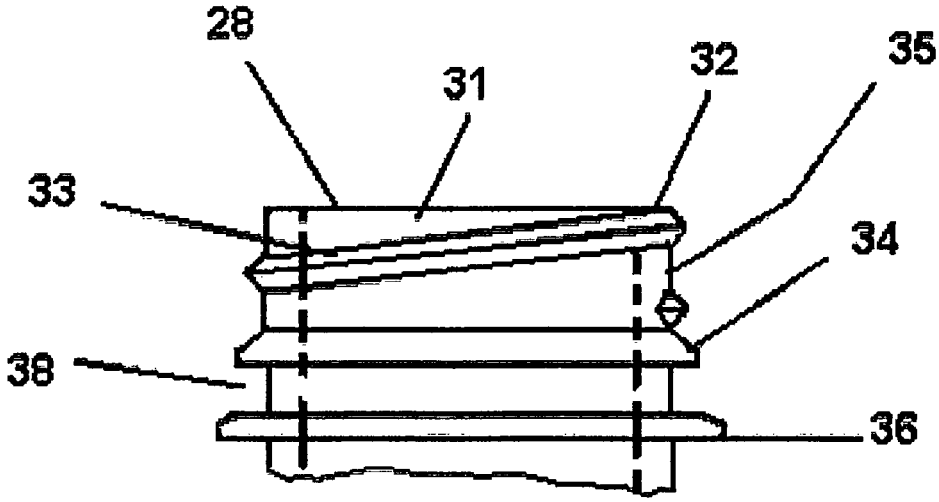
FIG. 3 is a partial side view of the neck of container of FIG. 1 prior to assembly of the tamper evident closure.

Referring to FIG. 3, the container 14 includes an upper neck 28 extending from a lower body portion 29 and having a central cylindrical axial passage 31 for the flow of material therethrough. The neck 28 includes an upper cylindrical section 32 having a helically threaded section 33 on an outer surface. An annular upper flange 34 is formed on the neck 30 below the sections 32, 33. An annular lower flange 36 is formed on the neck and axially spaced below the upper flange 34 and an outwardly opening tamper band retaining recess or groove 38.

Figure 7:
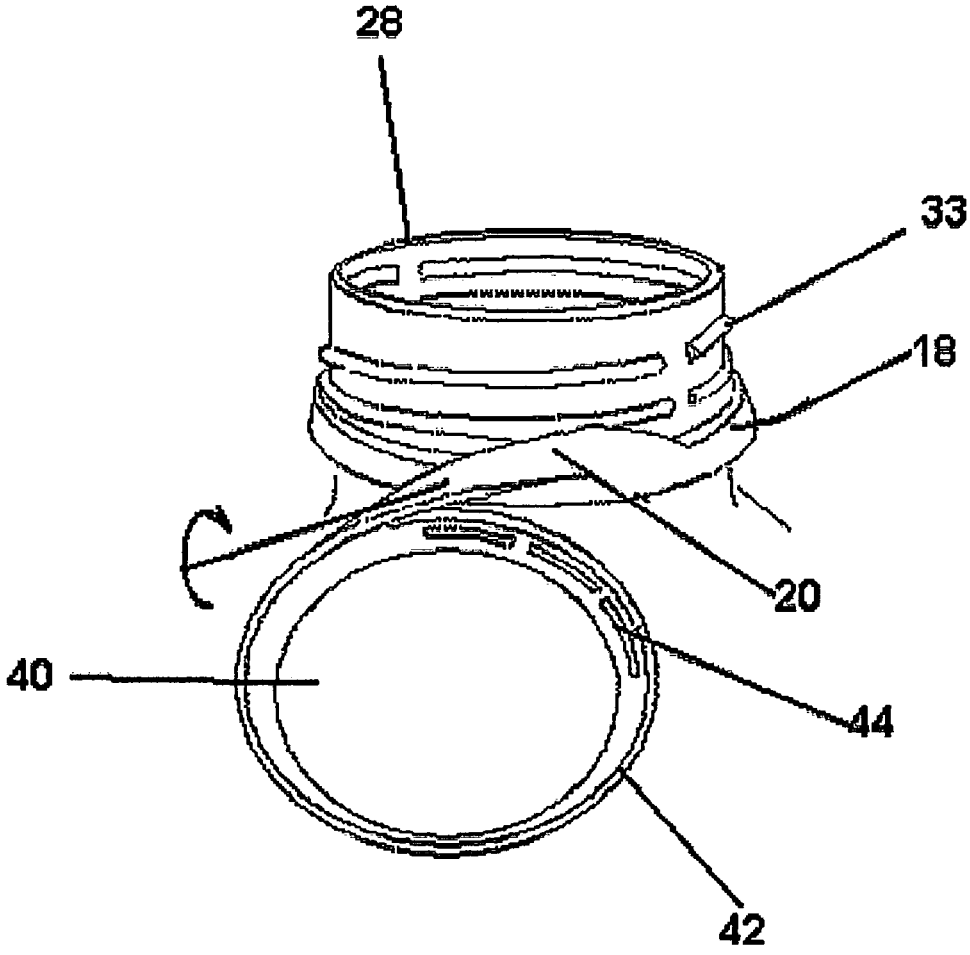
FIG. 7 is a partial side view of the container of FIG. 1 with the tamper evident closure in a third docked position.

Referring to FIG. 7, the cap 16 includes a circular lid 40 having a cylindrical skirt 42 depending downwardly therefrom. The skirt 42 may include axial ribs 43 or other surface conditionings on the outer surface for facilitating gripping and removal of the cap. The skirt 42 conventionally includes helical thread section(s) 44 on the interior surface. The thread sections 44 engage the complementary helical thread sections 33 on the annular neck 28 of the container 14 interacting conventionally during tightening or loosening rotation of the cap. The thread sections may be continuous or segmented, and single or multiple start.

Figure 10:
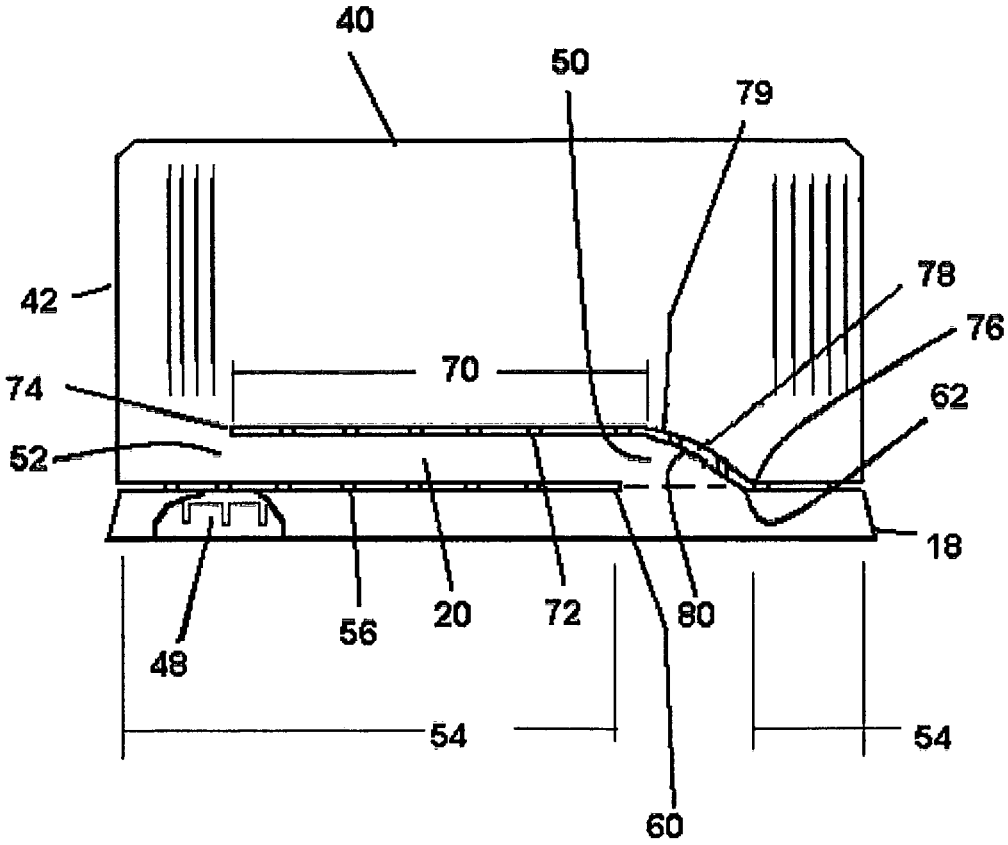
FIG. 10 is a side view of the tamper evident closure.

Referring to FIGS. 1,3 and 10, the tamper band 18 is cylindrical and retained in the groove 38 below the upper flange 34. The tamper band 18 includes a plurality of inwardly extending projections 48 (FIG. 10) that deflect over the upper flange 34 during installation of the closure 16 on the container 14 and serve to orient and upwardly axially retain the band 18 in the groove 38 thereafter. Many retaining devices have been proposed and conventionally used. Exemplary retention approached, without limitation, are disclosed in U.S. Pat. No. 5,725,115 to Bosl et al., U.S. Pat. No. 5,004,112 to McBride, and U.S. Pat. No. 5,913,437 to Ma.

Referring to FIG. 1 the tether 20 is an integral section of the skirt 42 and is axially connected to the tamper band 18 at a lower end or connecting section 50 and circumferentially connected at an upper end section 52 to the skirt 42. The end section 50 may include a circumferentially weakened cross section 51, allowing "living hinge" pivoting of the tether 20 relative to the tamper band 18 during deployment to the docked positions described below. Preferably, the section 52 has a width the same or greater than the height of the tether and/or a circumferential length of at least about 15° of the skirt perimeter.

Referring to FIGS. 3 and 10, the tamper band 18 is releasably attached to the lower surfaces of the tether 20 and the skirt 42 at a first circumferential sector 54 of weakened cross section comprising a series of spaced frangible sections 56 adjacent the upper flange 34 and extending between a starting end 60 and a finished end 62 on opposite sides of the axial connecting end section 50. The upper surface of the tether 20 is connected to the opposed section of the skirt 42 by a second circumferential sector 70 of weakened cross section having a series of frangible sections 72 having a starting end 74 and a finishing end 76 circumferentially intermediate the ends 60, 62. The finishing end 76 is connected with the finishing end 62 of the first sector by an axially curved section 78, between an axially curved section 79 on the skirt and a corresponding section 80 on the tether. The starting end of the second sector extends circumferentially beyond the connecting section establishing a free flexing length between the starting ends of about 90°. Such a tether length allows the tether to apply a torque to the cap establishing the resilient docked positions described below. Significantly above this length, the resiliency of the flexed tether is reduced resulting in insufficient biasing to maintain the docked position. Significantly below this length, cap cannot be rotated to establish the docked positions. Also for requisite resiliency, the axial height of the tether should be about ⅓ to ½ of the inside height of the skirt. Narrower sections develop insufficient torque in all three positions.

Figure 2:
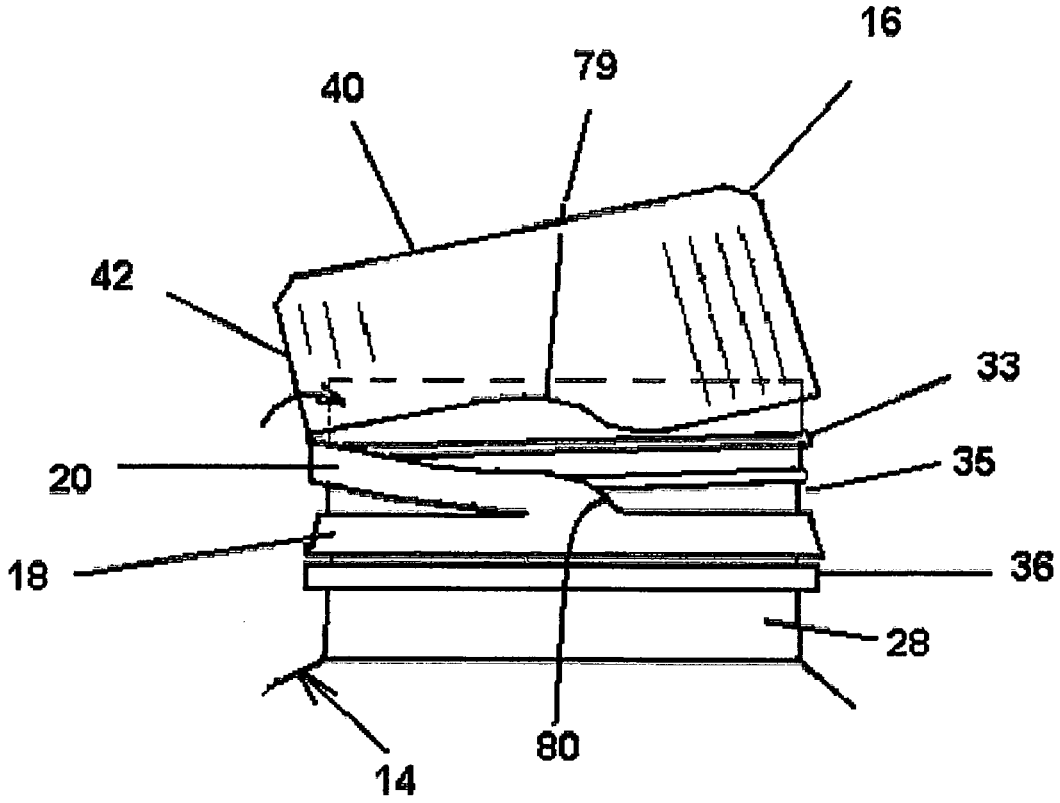
FIG. 2 is a partial front view of the tamper evident closure of FIG. 1 in the partially open position on the container.

Referring to FIGS. 2 and 3, for removal, the cap 16 is rotated counterclockwise. Such movement axially elevates the cap 16 while the tamper ring 18 is restrained by the upper flange 34. This causes a fracturing of the sections 40 and 42 resulting in the cap 16 being connected with the tamper ring 18 solely by the tether 20. When the inner closure thread sections 33 are above the container thread sections 44, the cap 16 assumes an inclination on the container with the tether exerting clockwise transverse torque on the cap.

Figure 4:
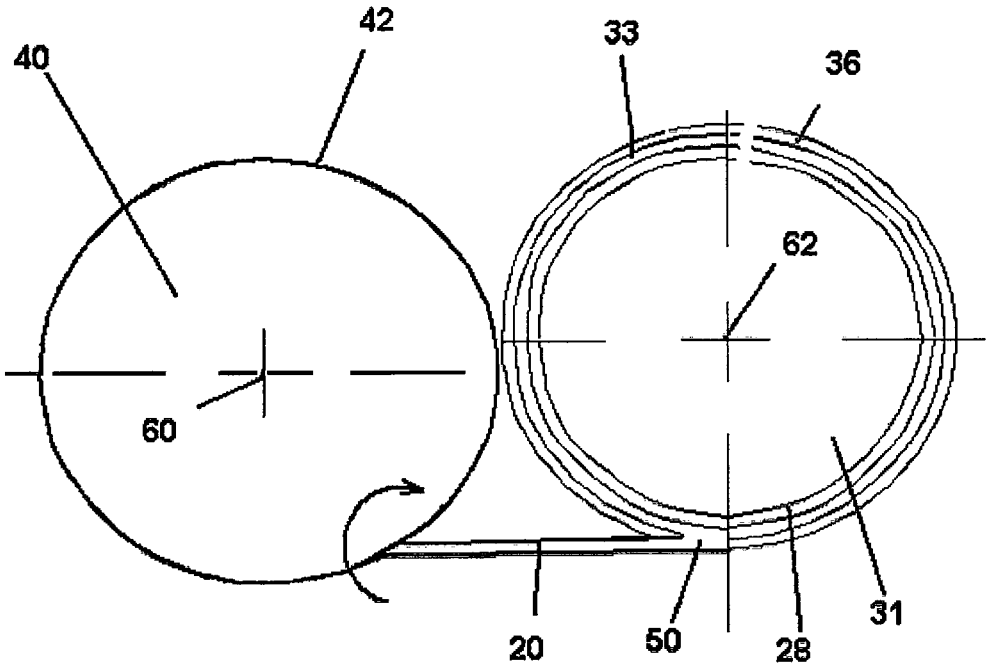
FIG. 4 is a partial top view of the container of FIG. 1 with the tamper evident closure in a first docked position.
Figure 5:
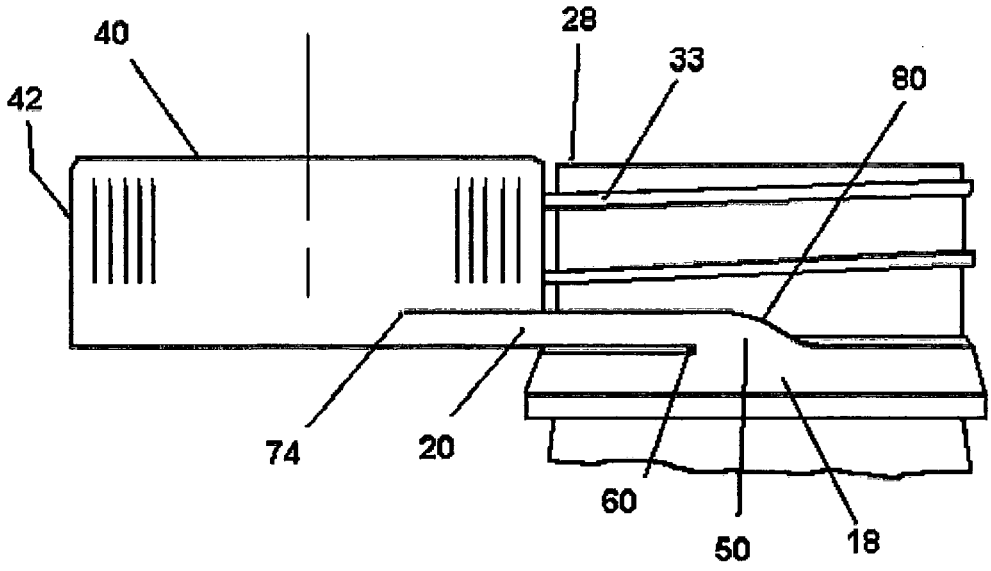
FIG. 5 is a partial side view of the container of FIG. 1 with the tamper evident closure in the first docked position.
Figure 8:
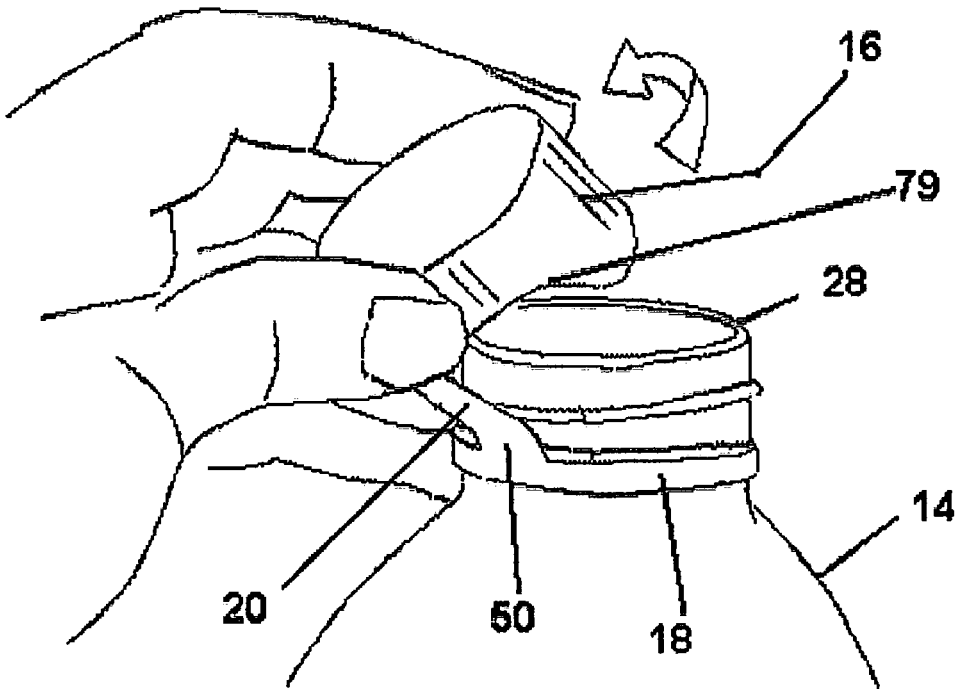
FIG. 8 is a perspective view showing user movement of the closure toward the docked positions.

For movement to a first docked operative position, the closure body, from the partially open position shown in FIG. 2 with the thread sections in the non-engaged position, is raised as shown in FIG. 8 and rotated outwardly about the tether 20 and lowered to a position as shown in FIGS. 4 and 5 wherein the axis 60 of the closure is parallel to the axis 62 of the container and opening 31. Thereat, the skirt 42 is resiliently biased by the tether 20 against the thread sections on the neck 28. The biasing is provided by the stressed cantilevered tether and flexing of the skirt about the ending point on the second tether sector. When released, the tether will apply a clockwise torque as indicated by the arrow to thereby resiliently hold the cap in a first docked position at the side of the container below the neck opening thereby allowing an unobstructed pouring of the container contents. This position is useful for pouring liquids and/or solids from the main container to a secondary reservoir, for example transfer of working liquids in automotive applications.

Figure 6:
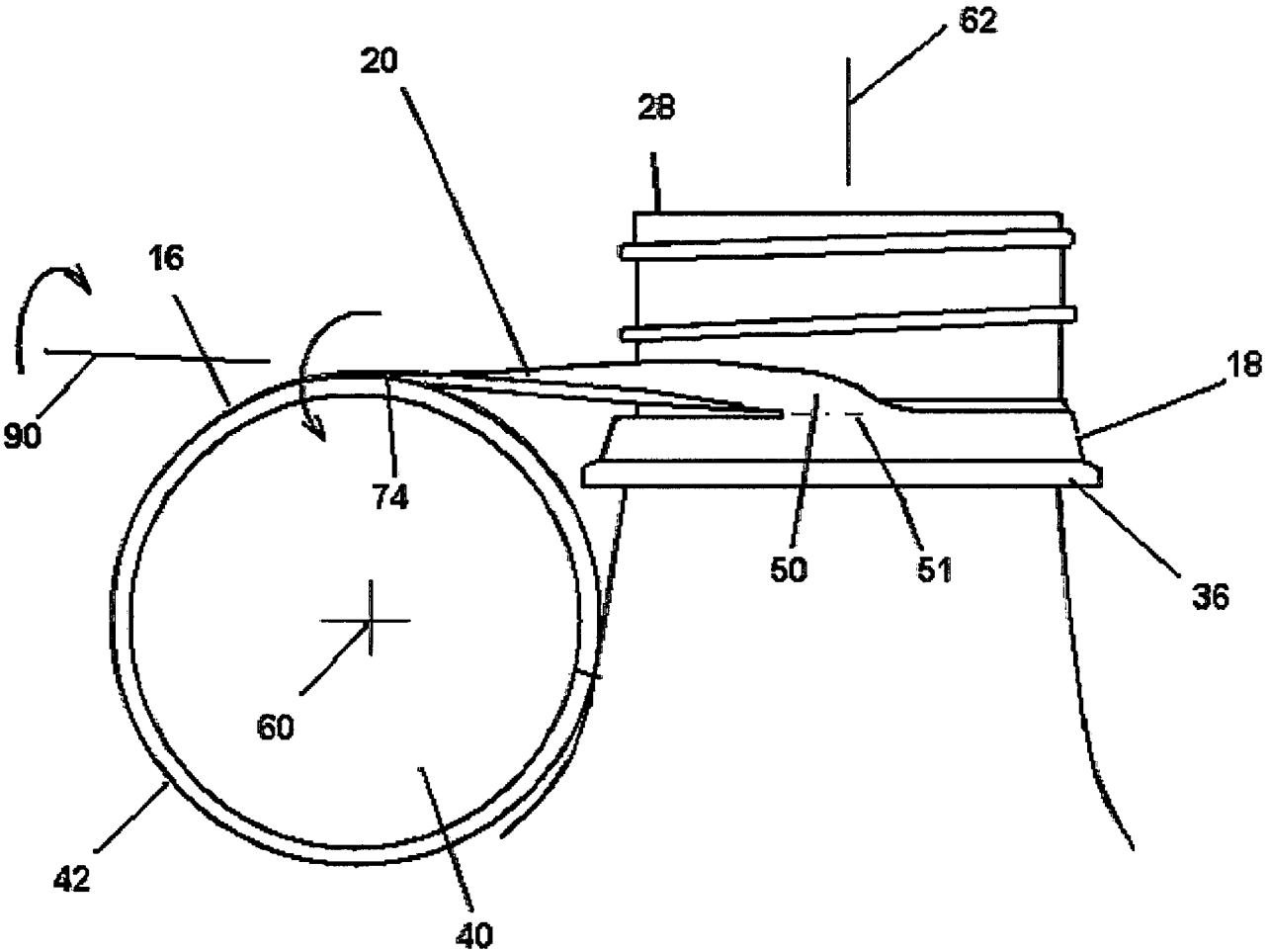
FIG. 6 is a partial side view of the container of FIG. 1 with the tamper evident closure in a second docked position.

For a second docked operative position as shown in FIG. 6, the cap is rotated 90° counterclockwise about the tether from the first docked position. Thereat, the skirt of the cap engages the container curvature below the bottom flange on the container neck with the skirt axis 60 transverse to the container axis 62. Thereat, the tether 20 applies an inward torque on the cap about a transverse axis as illustrated by the arrow for the resilient biasing for stable retention. This results in a stable position of the cap below the container neck allowing unobstructed pouring and consumption.

For a third docked operative position as shown in FIG. 7, the cap is rotated a further 90° and the top of the cap is biased by longitudinal twisting of the tether against the container below the bottom retaining ring. This further positions the cap remote from the container opening allowing unobstructed drinking therefrom without contacting the tethered cap.

For reuse the opening sequences are reversed from the docked position and the cap tightened on the thread section for sealed storage. When empty, the container with closure attached remains unitized for complete disposal and total recycling.

Figure 13:
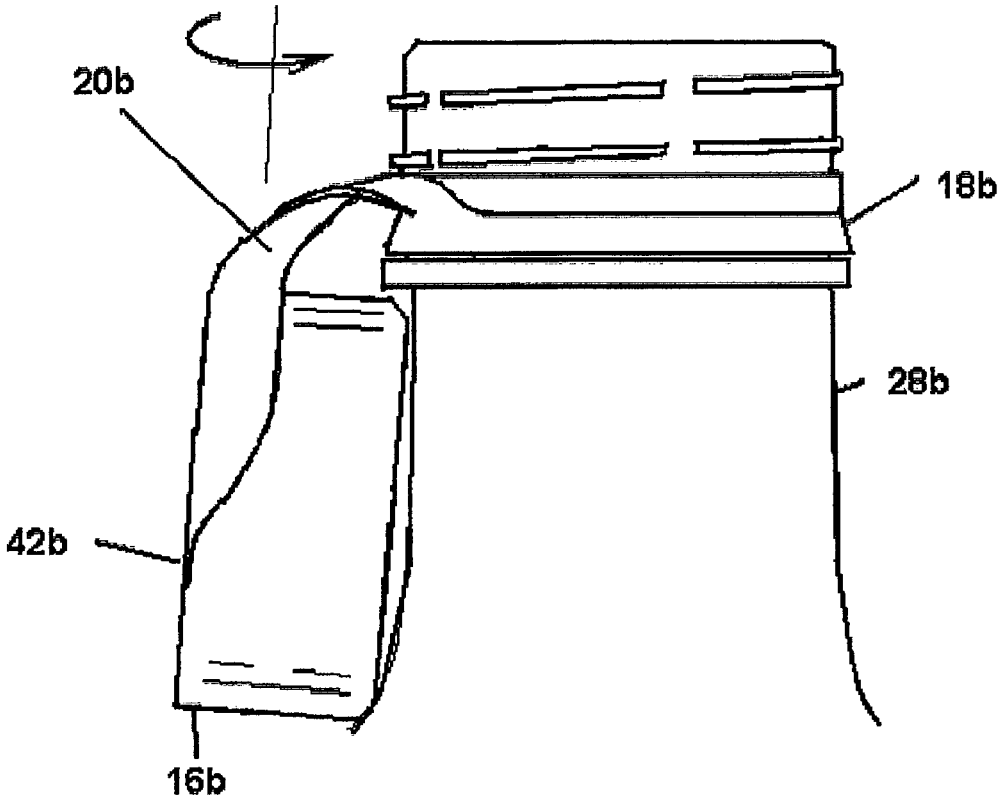
FIG. 13 is a side view of the tamper evident closure on a high neck container.

The closure is usable on a wide variety of container configuration. For instance, as shown in FIG. 13, shows the docked position of the cap 16*b* on a container 14*b* having an elongated neck 28*b* of the type commonly used for automotive fluids. The base 40*b* of the cap 16*b* is biased by the tether 20*b* against the neck 28*b* in the third docked position. The closure 16*b* is shown docked in a stay put out of the way position down and out of the way of the pouring spout. This lowered position allows for the bottle to be inverted and the bottle mouth opening placed inside the oil receiving opening of the mechanical device being filled with oil. The closure may be positioned on any side of the vessel since it can be spun about the bottle mouth opening should the user be a left handed individual or a right handed individual and have a preference to the location of the closure in the docked position.

Figure 9:
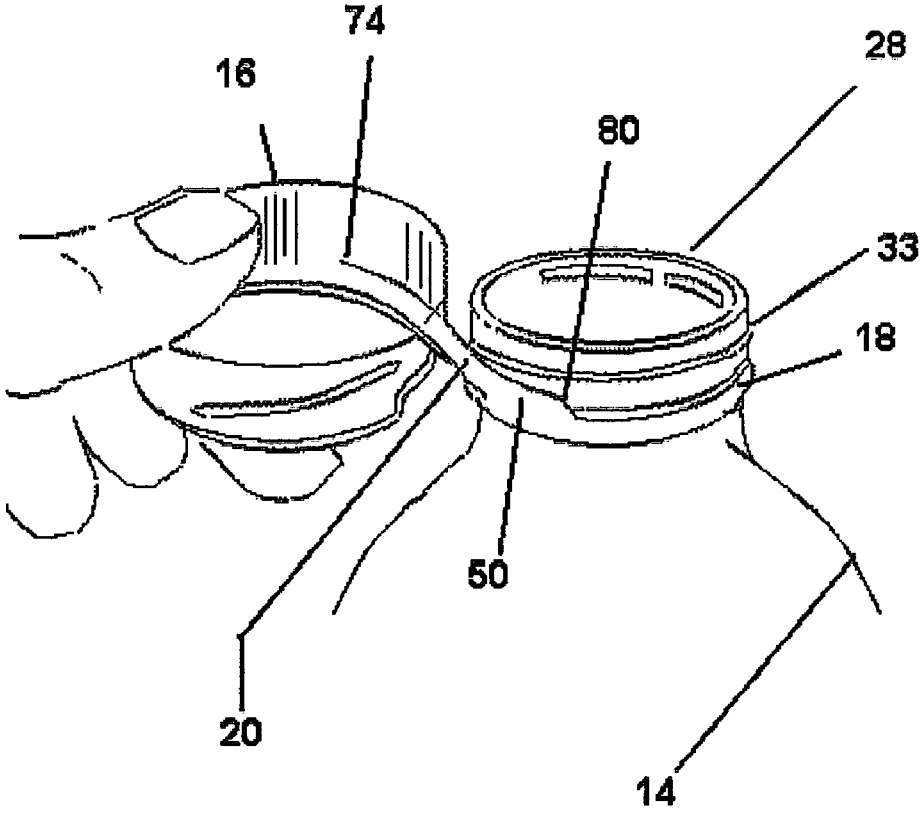
FIG. 9 is a perspective view showing further user movement of the closure toward the docked positions.
Figure 11:
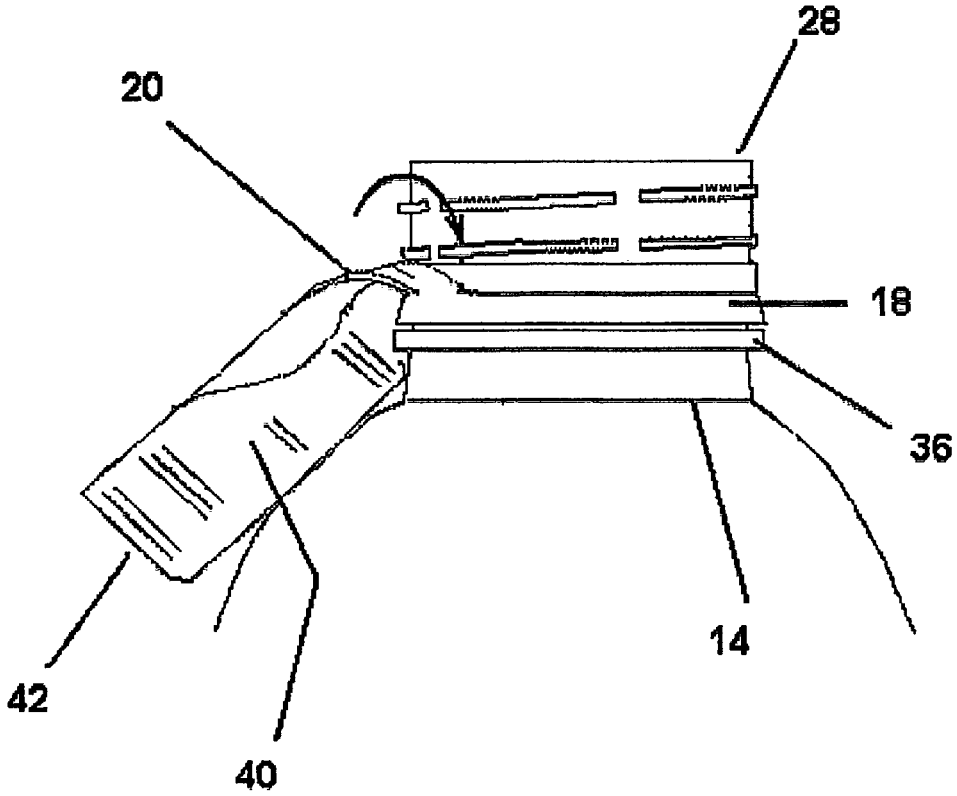
FIG. 11 is a side view of the closure of FIG. 1 in the third docked position.
Figure 12:
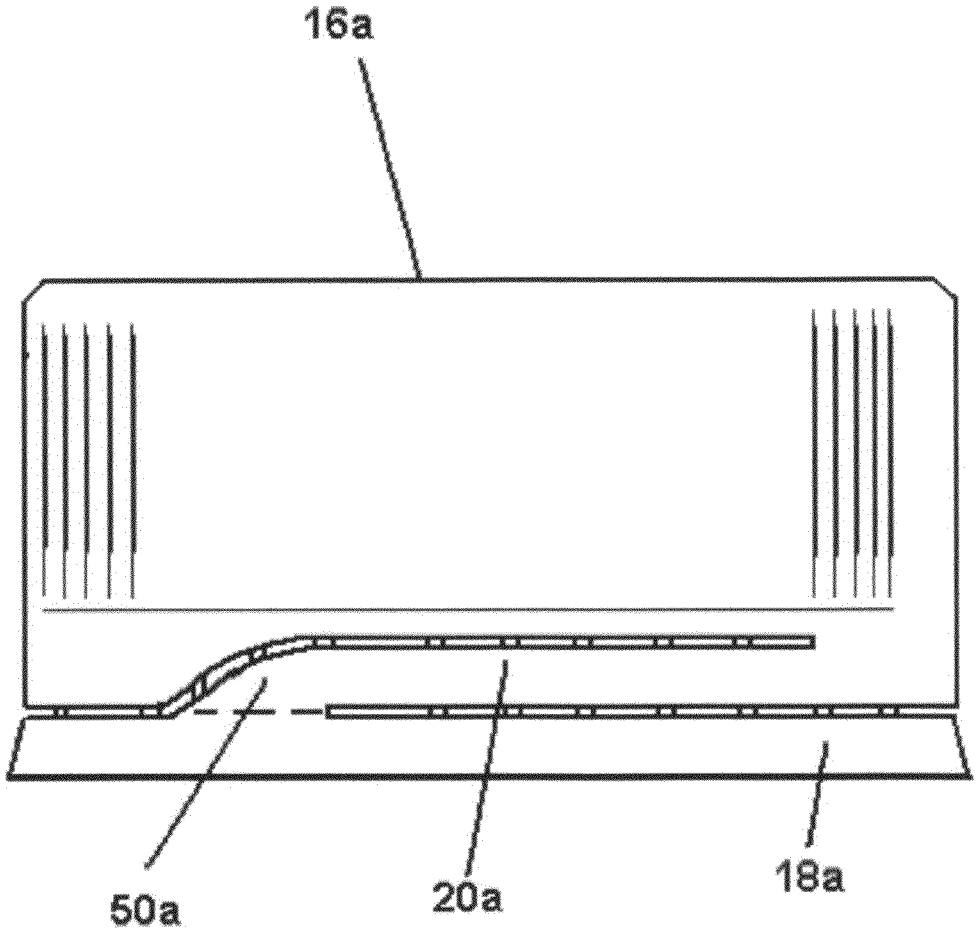
FIG. 12 is a side view of a tamper evident closure in accordance with another embodiment of the invention.

FIGS. 8, 9 and 11 show the closure of the present invention being opened, the cap 16 being inverted and elongated tab being twisted and then docked in an out of the way stay put position.

Figure 14:
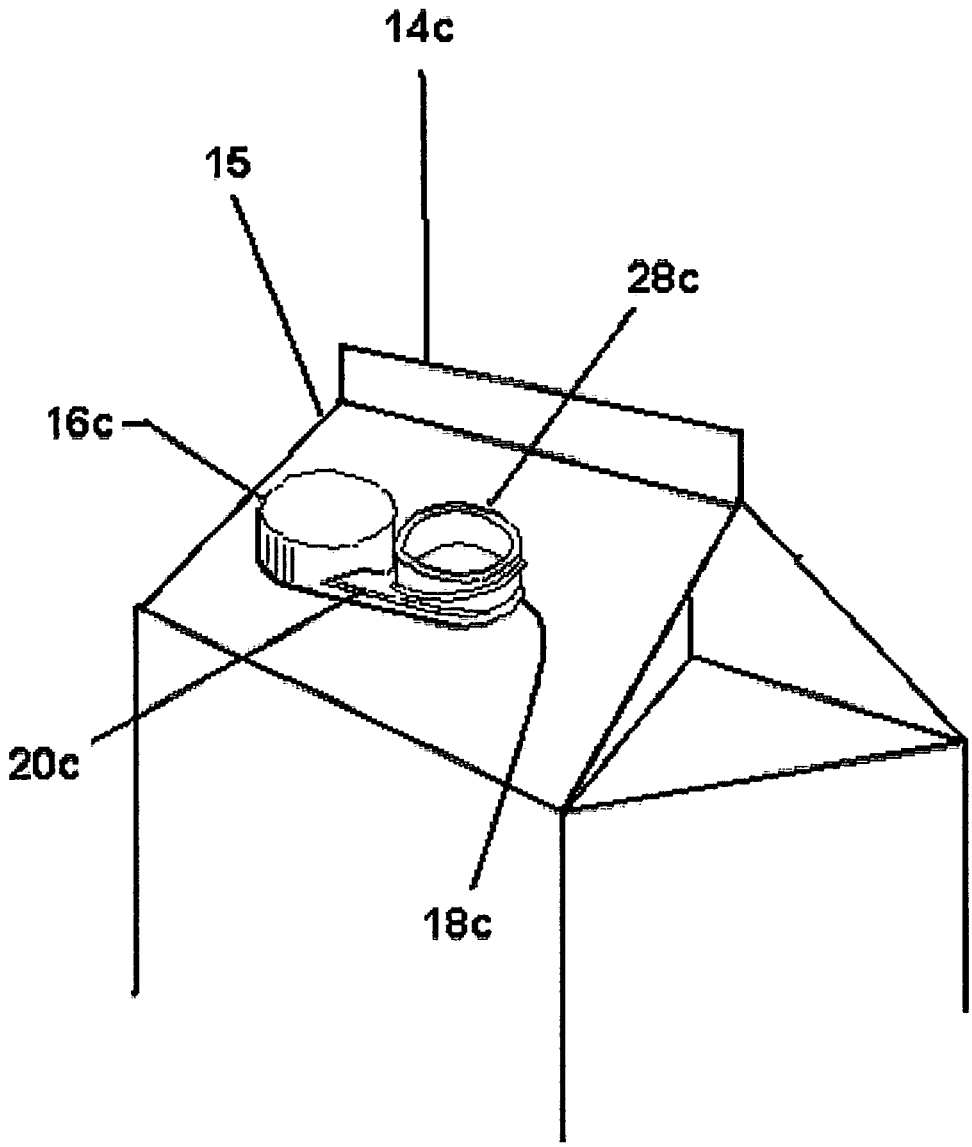
FIG. 14 is a perspective view of the closure on a flat wall beverage container in a docked position.
Figure 15:
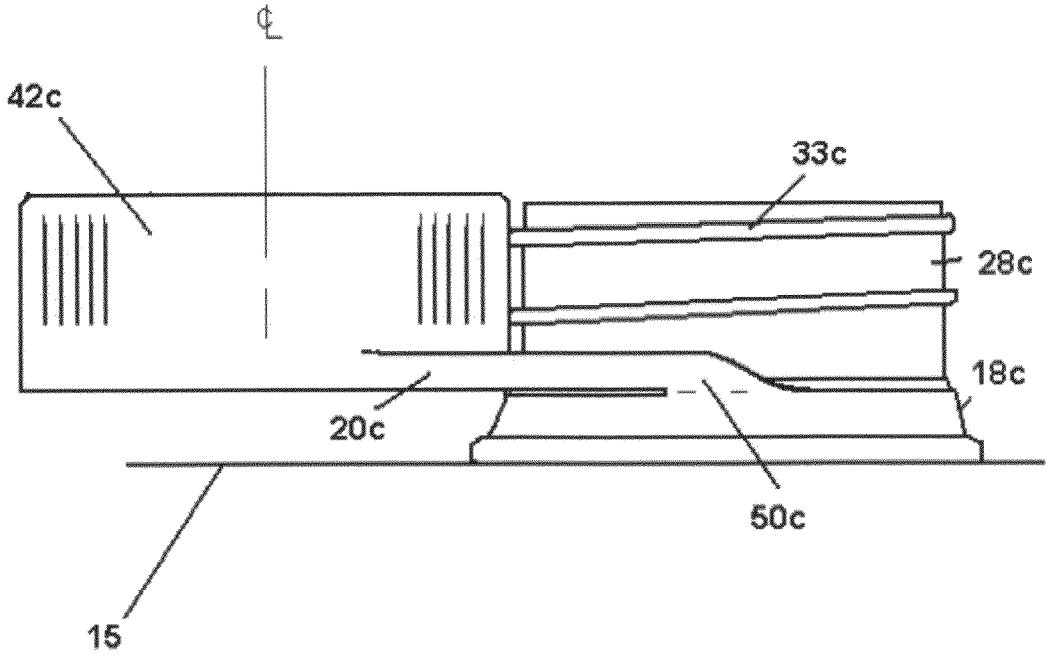
FIG. 15 is a side view of the closure on the container of FIG. 14.
Figure 16:
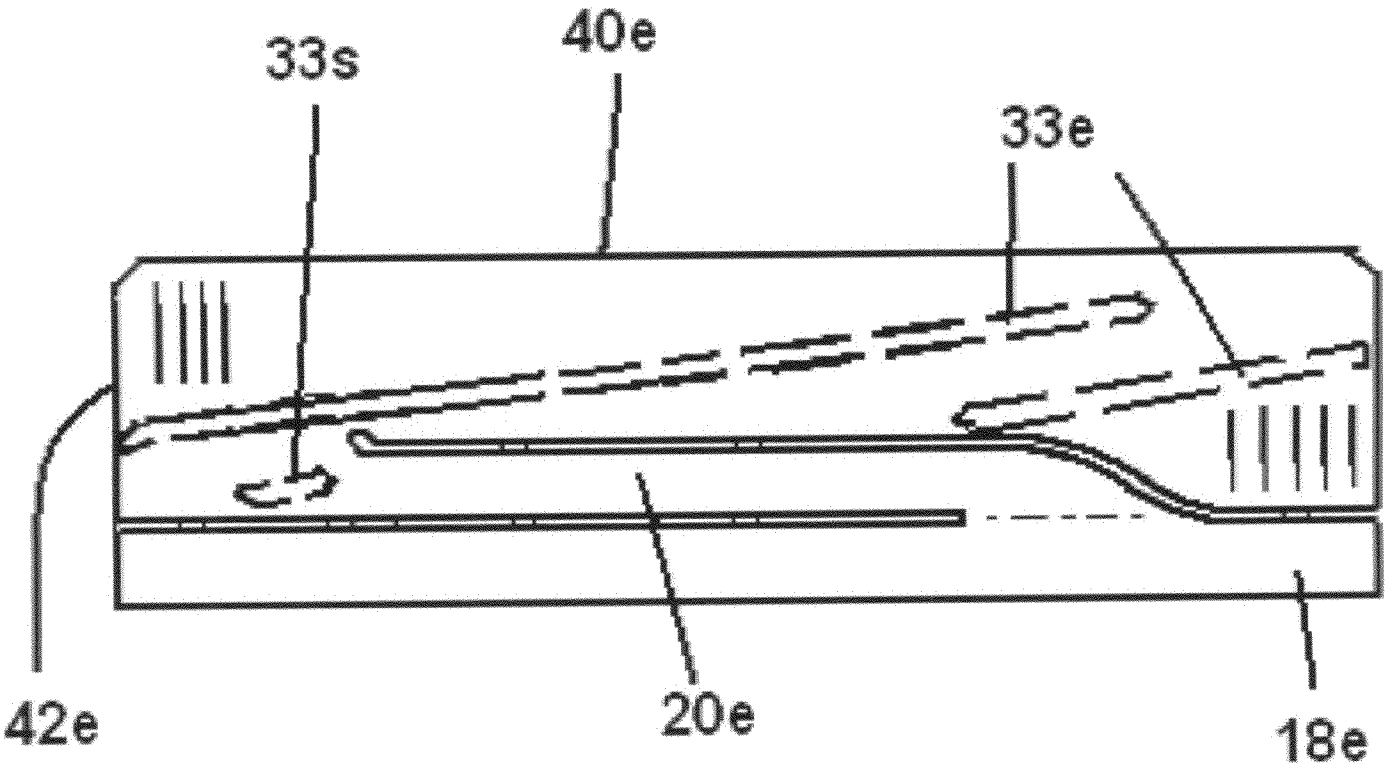
FIG. 16 is a side view of a low profile tamper evident closure in accordance with another embodiment of the invention.

Referring to FIGS. 14 and 15 shows the closure 16*c* of the present invention in an open position mounted on a container with no neck height. This application may be suitable for cartons and the like containers. In this position the cap will not dangle or move about. Therein, the neck 28*c* of the above described configuration is mounted on an inclined side wall 15. The closure 16*c* is uncapped and rotated to the first docked position allowing the unobstructed pouring therefrom. FIG. 16 shows the cap of the present invention in a low profile where tether segment 20*e* interrupts thread pattern 33*e*. Starter segment 33*s* is provided to aid in the registration of the cap during the capping operation.

Based on the foregoing, it will be appreciated that the closure of the present invention can be used on a variety of containers. The described embodiments and variants allow for the cap portion to be retained, and not removed, from the container thereby solving acknowledged litter problems, yet kept in an out-of-the-way position for effective use of the container for drinking or pouring. This function allows the user to use just one hand when drinking from the container since the user does not have to hold a detached cap in the opposite hand because there is no place to put the detached cap. It also allows for the container to be re-sealed and opened numerous times with out failure of the attachment section of the cap portion to the retaining ring portion. Such retention avoid misplaced container caps that present a danger to wildlife such as sea birds that often mistake caps for food and ingest the caps.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the spirit and scope of the present invention. The disclosures and description herein are intended to be illustrative and are not in any sense limiting of the invention, which is defined solely in accordance with the following claims.

What is claimed:

1. A closure for a container, said container including a cylindrical neck portion having:

a central passage; an outwardly extending annular upper flange having an annular retaining space therebelow; a container thread formed on an outer surface of said neck portion above said upper flange; and an annular end surface surrounding said passage, said closure comprising:

a circular cover section for engaging said end surface of said neck portion and a cylindrical skirt portion extending downwardly from said cover section and surrounding said neck portion of said container and having a lower end about, at, or above said upper flange; a closure thread on an interior surface of said skirt portion operatively engaging said container thread for manually raising and lowering of said closure with respect to said container between a closed position whereat said cover section engages said end surface and an open position wherein said threads are disengaged; an annular retaining band in said retaining space and having inwardly extending projections for engaging said upper flange to prevent upward movement of said band in assembly; a frangible first sector connecting a lower end of said skirt portion to said retaining band, said first sector extending circumferentially around said lower end of said skirt portion and having end sections circumferentially spaced by a narrow non-frangible connecting section;

a frangible second sector in said skirt section above said first sector and having a first end connected at one end section of said connecting section and a second end extending beyond the other end section thereby providing a circumferential tether section completely within said skirt section and between said retaining band; said sectors separating during rotation of said closure to said open position, wherein said tether section spans said second sector of said skirt section substantially less than said first sector and has a length accommodating resilient engagement of said skirt portion against said neck portion.

2. The closure as recited in claim 1 wherein said tether section has an axial height of about ½ to ⅓ of said inside surface of said skirt section.

3. The closure as recited in claim 1 wherein said connecting section spans a sector of skirt section of about 15° and there are a plurality of predetermined docked positions.

4. The closure as recited in claim 3 wherein said connecting section includes a reduced radial cross section connecting with said retaining band allowing transverse pivoting of said tether section during movement to said at least one of said predetermined docked positions, each of said predetermined docked positions being stable.

5. A closure for a filler neck of a container, comprising:

a closure body having a cover and a peripheral skirt for enclosing the neck of the container and a retaining band below a lower end of said skirt encircling the neck and retained in an annular groove by an annular flange against axial movement;

a circumferential tether formed entirely in said skirt for connecting said closure body to the container after opening, said tether being defined by a first circumferential sector of weakened section between said lower end of said skirt and said band having a circumferential length extending substantially completely around said lower end of said skirt and having a starting end and a finishing end on opposed sides of a narrow integral bridge section flexibly connecting said band to said skirt, said tether being defined by a second circumferential sector of weakened section formed in said skirt above said first sector, said second sector having a finishing end adjacent said finishing end of said first sector with said finishing ends being interconnected by an axial connecting section, said second sector having a starting end circumferentially extending beyond said starting end of said first section thereby providing a tether length circumferentially between said starting ends and having a circumferential length in said second sector substantially less than said first sector, a thread section on an interior surface of said skirt operative with a complementary thread section on an outer surface of the neck of the container for accommodating rotation of the cap to raise the closure body to an open position severing said weakened sections maintaining connection of said skirt to said retaining band by said tether, said tether length providing resilient biasing of said skirt against said neck in at least one of a plurality of predetermined stable docking positions.

6. The closure as recited in claim 5 wherein said tether length accommodates rotation of said closure about said tether section to a second predetermined stable docked position wherein said skirt portion engages and is biased by said tether section against said container transverse to said neck portion.

7. The closure as recited in claim 6 wherein tether length accommodates rotation of said closure beyond said second predetermined stable docked position to a third predetermined stable docked position wherein said cover portion of the closure is resiliently biased by said tether section against the container by the tether.

8. A method of retaining a closure for a container in at least one predetermined stable docked position on a neck of a container for an unobstructed transfer of contents therefrom, said method comprising the steps of:

a. providing a container having a filler neck with an axial passage terminating with an annular end surface wherein said filler neck includes a first thread section on an outer surface below said end surface and an annular outwardly extending retaining surface on said neck below said first thread section;

b. providing a closure body having a circular top portion with a surface engaging said end surface of said neck and a cylindrical skirt portion depending from the periphery of said top portion and surrounding said neck and said first thread section, said skirt portion having an inner surface with a second thread section operatively engaging said first thread section for moving upon rotation said closure between a closed position and an open position;

c. providing an annular retaining member at said retaining space connected to said skirt portion at a first sector of frangible material, wherein first and second ends of said first sector extend circumferentially around said skirt portion are separated by an axial non-frangible narrow connecting section;

d. providing a second sector of frangible material in said skirt portion axially above said first sector, said second sector having a starting end a circumferential distance remote from said first end of said first sector and said second section and having a finishing end at said connecting section intermediate said first and second ends, said finishing end being connected to said second end of said first sector by an axial weakened connecting sector thereby forming a tether section;

e. rotating said closure to said open position and thereby separating said tether section, said skirt section and said retaining member at said sectors; and f. providing a circumferential length for said tether section substantially less that the first sector (i) accommodating movement of said closure from said open position to a predetermined stable first docked position wherein said skirt section engages and is resiliently biased against said neck portion by the tether section in a first docked position; (ii) accommodating rotation of said closure about said tether section to a second open predetermined stable docked position wherein said skirt portion engages and is biased by said tether section against said container transverse to said neck portion; and (iii) accommodating rotation of said closure beyond said second docked position to a third predetermined stable docked position wherein said cover portion of the closure is resiliently biased by said tether section against the container by the tether.

9. A container assembly, comprising:

a container, said container including a cylindrical neck portion having: a central passage; an outwardly extending annular upper flange having an annular retaining space therebelow; a container thread formed on an outer surface of said neck portion above said upper flange; and an annular end surface surrounding said passage:

a closure having a circular cover section for engaging said end surface of said neck portion and a cylindrical skirt portion extending downwardly from said cover section and surrounding said neck portion of said container and having a lower end above said upper flange; a closure thread on an interior surface of said skirt portion operatively engaging said container thread for manually raising and lowering of said closure with respect to said container between a closed position whereat said cover section engages said end surface and an open position wherein said threads are disengaged; an annular retaining band in said retaining space and having inwardly extending projections for engaging said upper flange to prevent upward movement of said band in assembly; a frangible first sector connecting a lower end of said skirt portion to said retaining band, said first sector extending substantially circumferentially around said lower end of said skirt portion and having end sections circumferentially spaced by a narrow non-frangible connecting section; a frangible second sector in said skirt section above said first sector and having a first end connected at one end section of said connecting section and a second end extending beyond the other end section thereby providing a circumferential tether section within said skirt section and between said retaining band; said sectors separating during rotation of said closure to said open position, wherein said tether section spans said second sector of said skirt section substantially less than said first sector and has a length accommodating resilient engagement of said skirt portion against said neck portion; wherein the finishing end of the second sector is connected with the finishing end of the first sector by an axially curved section between an axially curved section on the skirt and a corresponding section on the tether and a lower end of the tether includes a circumferentially weaken cross section between the first sector's starting end and the first sector's finishing end, allowing living hinge pivoting of the tether relative to the tamper band during deployment to at least one stable docked position.

10. The closure as recited in claim 5 wherein said second sector spans about 90°.

11. The closure as recited in claim 10 wherein said connecting section spans a sector of at about 15°.

12. A closure for a filler neck of a container, said closure comprising:

a closure body having a cover and a peripheral skirt for enclosing the neck of the container and a retaining band below a lower end of said skirt encircling the neck and retained in an annular groove by an annular flange against axial movement;

a circumferential tether formed in said skirt for connecting said closure body to the container after opening, said tether being defined by a first circumferential sector of weakened section between said lower end of said skirt and said band having a circumferential length extending substantially completely around said lower end of said skirt and having a starting end and a finishing end on opposed sides of a narrow integral bridge section flexibly connecting said band to said skirt;

said tether being further defined by a second circumferential sector of weakened section formed in said skirt above said first sector, said second sector having a finishing end adjacent said finishing end of said first sector with said finishing ends being interconnected by an axial connecting section, said second sector having a starting end circumferentially extending beyond said starting end of said first section thereby providing a tether length circumferentially between said starting ends and having a circumferential length in said second sector substantially less than said first sector;

a thread section on an interior surface of said skirt operative with a complementary thread section on an outer surface of the neck of the container for accommodating rotation of the cap to raise the closure body to an open position severing said weakened sections maintaining connection of said skirt to said retaining band by said tether, wherein said tether is in an axial plane intersecting said thread section on said interior surface.

13. The closure as recited in claim 12 wherein said tether intersects a portion of said thread section.

14. The closure as recited in claim 1 wherein said tether section has a length; (a) accommodating movement of said closure from said open position to a first stable docked position wherein said skirt section engages and is resiliently biased against said neck portion by the tether section in a first predetermined docked position and/or; (b) accommodating rotation of said closure about said tether section to a second predetermined docked position wherein said skirt portion engages and is biased by said tether section against said container transverse to said neck portion; and/or (c) accommodating rotation of said closure beyond said second docked position to a predetermined third docked position wherein said cover portion of the closure is resiliently biased by said tether section against the container by the tether section.

15. The closure as recited in claim 1 wherein said tether section has a circumferential length of about 90°.

16. The method as recited in claim 8 wherein said tether has a circumferential length of about 90°.

17. The closure as recited in claim 9 wherein there are a plurality of stable docked positions, each of which is predetermined.

* * * * *